US007536983B2

(12) United States Patent
Layher et al.

(10) Patent No.: US 7,536,983 B2
(45) Date of Patent: May 26, 2009

(54) INTERNAL COMBUSTION ENGINE AND METHOD FOR OPERATING AN INTERNAL COMBUSTION ENGINE

(75) Inventors: Wolfgang Layher, Waiblingen (DE); Georg Maier, Stetten (DE); Martin Rieber, Stuttgart (DE); Tobias Flämig-Vetter, Esslingen (DE); Jens Reimer, Stuttgart (DE); Andreas Krups, Stuttgart (DE); Dieter Bächle, Weil im Schönbuch (DE); Helmut Visel, Neustetten (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 105 days.

(21) Appl. No.: 11/623,763

(22) Filed: Jan. 17, 2007

(65) Prior Publication Data

US 2007/0163557 A1 Jul. 19, 2007

(30) Foreign Application Priority Data

Jan. 19, 2006 (DE) ..... 10 2006 002 486

(51) Int. Cl.
*F02B 25/00* (2006.01)

(52) U.S. Cl. ..... 123/73 B; 123/73 PP; 73/114.16; 73/114.33; 73/114.34; 701/103

(58) Field of Classification Search ..... 123/73 PP, 123/73 C, 73 R, 73 A, 73 B, 435, 436, 406.22, 123/406.41; 701/103–105; 73/114.16–114.18, 73/114.33–114.34

See application file for complete search history.

(56) References Cited

U.S. PATENT DOCUMENTS

| | | | | | |
|---|---|---|---|---|---|
| 4,995,258 | A | * | 2/1991 | Frank | 73/114.32 |
| 5,051,909 | A | * | 9/1991 | Gomez et al. | 701/103 |
| 5,284,118 | A | * | 2/1994 | Kato et al. | 123/478 |
| 5,586,524 | A | * | 12/1996 | Nonaka et al. | 123/73 A |
| 5,606,952 | A | * | 3/1997 | Kanno et al. | 123/406.74 |
| 5,615,645 | A | * | 4/1997 | Kanno | 123/73 C |
| 5,622,158 | A | * | 4/1997 | Katoh et al. | 123/676 |
| 5,630,395 | A | * | 5/1997 | Katoh et al. | 123/406.44 |
| 5,665,025 | A | * | 9/1997 | Katoh | 477/107 |
| 5,673,667 | A | * | 10/1997 | Nakamura | 123/406.29 |
| 5,682,867 | A | * | 11/1997 | Katoh et al. | 123/676 |
| 5,738,074 | A | * | 4/1998 | Nakamura et al. | 123/305 |
| 5,775,311 | A | * | 7/1998 | Kato et al. | 123/681 |
| 5,778,857 | A | * | 7/1998 | Nakamura et al. | 123/406.37 |
| 2003/0209214 | A1 | | 11/2003 | Rosskamp | |
| 2008/0041144 | A1 | * | 2/2008 | Layher et al. | 73/115 |

* cited by examiner

*Primary Examiner*—Hai H Huynh
(74) *Attorney, Agent, or Firm*—Gudrun E. Huckett

(57) ABSTRACT

An internal combustion engine has a cylinder with a combustion chamber delimited by a reciprocating piston that drives a crankshaft rotatably supported in a crankcase. The internal combustion engine has an intake passage, an exhaust connected to the combustion chamber, a device supplying fuel, and a control device controlling at least one operating parameter of the internal combustion engine. The internal combustion engine is operated in that a pressure is measured in operation of the internal combustion engine, an adjustable value for at least one operating parameter of the internal combustion engine is deteremined based on the measured pressure, and the determined adjustable value is set for optimized running of the engine.

35 Claims, 6 Drawing Sheets

INTERNAL COMBUSTION ENGINE AND METHOD FOR OPERATING AN INTERNAL COMBUSTION ENGINE

BACKGROUND OF THE INVENTION

The invention relates to a method for operating an internal combustion engine and to an internal combustion engine for performing the method. The internal combustion engine has a cylinder in which a combustion chamber is formed wherein the combustion chamber is delimited by a reciprocating piston that drives a crankshaft rotatably supported in a crankcase. The internal combustion engine further comprises an intake passage, an exhaust connected to the combustion chamber, and a device for supplying fuel. A control device for controlling at least one operating parameter of the internal combustion engine or for controlling the internal combustion engine is provided.

U.S. 2003/0209214 A1 discloses an internal combustion engine and a method for operating the internal combustion engine in which the combustion air is supplied to the crankcase and is transferred into the combustion chamber through transfer passages. When the combustion air is transferred into the combustion chamber, fuel is admixed; within the combustion chamber the added fuel and the combustion air form a fuel/air mixture that is ignited. The quantity of fuel supplied to the motor, the timing of the fuel supply, and the ignition timing can be controlled.

SUMMARY OF THE INVENTION

It is an object of the present invention to provide a method for operating an internal combustion engine with which in a simple way a stable operation of the internal combustion engine and minimal exhaust gas values are achieved. A further object of the invention is to provide an internal combustion engine with which the method can be performed.

In accordance with the present invention, this is achieved in regard to the method in that, in operation of the internal combustion engine, a pressure is measured and, based on the measured pressure, an adjustable value for at least one controllable operating parameter of the internal combustion engine is determined and the determined value is then adjusted for the operating parameter.

In accordance with the present invention, this is achieved in regard to the internal combustion engine in that the internal combustion engine has a pressure sensor for determining the crankcase pressure.

It has been found that, in operation of the internal combustion engine, different pressure values are present at different operating states, in particular in the crankcase. The pressure in the crankcase can be determined precisely in accordance with the working cycle in a simple way with minimal expenditure. In this connection, several pressure measurements for each working cycle are possible also. The pressure measurement can be carried out continuously or can be performed at indiviudal, predetermined points in time. Advantageously, for each working cycle of the internal combustion engine at least one pressure measurement, preferably at least two pressure measurements, are carried out. However, it is also possible to provide a plurality of pressure measurements for each working cycle. It can also be provided to perform pressure measurements in the crankcase at predetermined intervals, for example, for every other working cycle, and not for every working cycle. Characteristic pressure values are present in operation also in other components, for example, in the cylinder and in a muffler connected to the internal combustion engine, which pressure values can differ from operating state to operating state. Instead of measuring the crankcase pressure, a measurement of the pressure in another component, for example, the cylinder or the muffler, can be advantageous also. Advantageously, the pressure is measured in the crankcase.

Based on the measured pressure, for one or several controllable operating parameters of the internal combustion engine an adjustable value can be determined. The adjustable value is in particular the value for which an optimal running of the engine and/or optimal exhaust gas values are obtained. The determined value for the operating parameter is then adjusted. In this way, a simple control of the internal combustion engine can be realized. Controllable operating parameters in this context are all parameters of the internal combustion engine that can be adjusted, for example, the quantity of supplied fuel or the ignition timing. A controllable operating parameter can be also the timing of the fuel supply, for example.

Advantageously, the pressure, in particular the pressure in the crankcase, is measured as a relative pressure relative to a reference pressure. The reference pressure can be the ambient pressure. However, it is also possible to employ as a reference pressure the pressure within the intake passage, in the clean-room of an air filter of the internal combustion engine, in the cylinder, or in the muffler of the internal combustion engine. The reference pressure can be a calibrated or a non-calibrated reference pressure. A pressure sensor for determining a relative pressure is of a simpler configuration than a pressure sensor for measuring absolute values. In particular in the case of measuring the pressure relative to a non-calibrated reference pressure, a complex calibration of the pressure sensor is not required.

Advantageously, a temperature, particularly the temperature in the crankcase, is measured. The temperature provides an indication for the operating state of the internal combustion engine so that the temperature can be used also for determining an adjustable value for an operating parameter of the internal combustion engine. The temperature is in particular measured as an engine component temperature. The measurement of an engine component temperature can be realized in a simpler way than measurement of a gas temperature, such as the gas temperature in the crankcase, in the cylinder, in the muffler or the like. Measuring a component temperature in this connection is sufficiently precise in particular when measuring an average temperature. Advantageously, the temperature of the crankcase is measured. In particular, the average temperature of the crankcase is measured. Preferably, the pressure and the temperature are measured by a combined pressure/temperature sensor, in particular when measuring the pressure and the temperature in the crankcase. In this way, the measurement of both parameters is possible with a compact sensor. The number of components and the mounting expenditure are reduced.

The pressure in the crankcase is measured in particular at a predetermined crankshaft angle. The predetermined crankshaft angle is constructively correlated with a predetermined crankcase volume. The pressure is advantageously measured at a crankshaft angle at which the crankcase is closed off. At this time a closed or defined volume is present in the crankcase. In particular, when the internal combustion engine is a two-stroke engine, it is possible to deduce the quantity of combustion air contained in the crankcase by measuring the temperature and the pressure. Advantageously, the engine speed of the internal combustion engine is measured also.

It is provided that, based on the measured pressure in the crankcase, the quantity of air flowing through the combustion chamber is determined. In order to ensure that in the combustion chamber an ignitable mixture is formed and in order to achieve at the same time a combustion as complete as possible so that low exhaust gas values will be achieved, it is desirable to provide in the combustion chamber a predetermined ratio of fuel and air, i.e., a predetermined air ratio lambda. The resulting air ratio lambda depends on the supplied quantity of fuel and the supplied quantity of combustion air. In order to adjust a predetermined lambda value in the combustion chamber, the quantity of combustion engine transferred into the combustion chamber must be known so that an appropriate quantity of fuel can be added. It has been found that the required quantity of fuel depends, for example, on the pressure that is present within the crankcase during operation of the internal combustion engine.

It is provided that the air quantity is determined by means of a characteristic map that provides information in regard to the air quantity as air mass flow as a function of the engine speed and the pressure in the crankcase at the predetermined crankshaft angle. It was found that the air mass flow through the crankcase not only depends on the pressure at the predetermined crankshaft angle but also on the engine speed. By means of the characteristic map, the air mass flow can be determined with satisfactory precision so that a cycle-precise adjustment of an operating parameter, for example, metering of an optimal fuel quantity, is possible. The temperature in the crankcase also has an effect on the air mass flow. In order to compensate for this, it is provided that the measured pressure is corrected based on the measured temperature and the air mass flow is determined in the characteristic map based on the corrected pressure value. In this way, a more precise determination of the air mass flow is possible. In this connection, the pressure is measured in particular as a relative pressure relative to a reference pressure. The reference pressure is advantageously a calibrated reference pressure.

It can also be provided that the air mass flow through the combustion chamber is calculated. Expediently, the pressure in the crankcase is measured at a first crankshaft angle during the compression phase in the crankcase and at a second crankshaft angle during the expansion phase in the crankcase. The volume of the crankcase at the first crankshaft angle corresponds in particular to the volume of the crankcase at the second crankshaft angle. For identical crankcase volume, the pressure drop at the second crankshaft angle, i.e., at the second point in time, relative to the first point in time is caused by the quantity of combustion air that has been transferred into the combustion chamber. Based on the pressure drop, the transferred combustion air quantity and thus the air mass flow from the crankcase into the combustion chamber can be determined by means of the ideal-gas law. However, the volume of the crankcase can be different at the two points in time. In this situation, the design-based different volumes of the crankcase at both points in time must be known.

The internal combustion engine is in particular a two-stroke engine with at least one transfer passage through which the combustion air that has been sucked into the crankcase is transferred into the combustion chamber. Expediently, the two-stroke engine has an intake passage through which the combustion air is sucked into the crankcase. The calculation of the air quantity is advantageously realized by means of the ideal-gas law based on the calculation of the combustion air mass flow transferred during a working cycle into the combustion chamber. The calculation is based on the pressure and the temperature at the first crankshaft angle, the pressure and the temperature at the second crankshaft angle, the volume of the crankcase at both crankshaft angles, and the gas constant. In this connection, the transferred combustion air mass is proportional to the volume of the crankcase and proportional to the difference of the quotients of pressure and temperature at the two crankshaft angles. The transferred combustion air mass flow results then in accordance with the equation $m=\Delta m*A/60$, wherein m is the transferred air mass flow, $\Delta m$ is the transferred combustion air quantity for each working cycle, and A is the number of working cycles per minute.

The transferred combustion air mass can therefore be determined as a function of the difference of the pressures at both crankshaft angles. Since for calculating the transferred combustion air mass only the pressure difference is required, it is possible to employ a relative pressure sensor for the measurement of the pressures; such a relative pressure sensor measures the pressure relative to a non-calibrated reference pressure. Such a relative pressure sensor is of a simple and robust construction. Because the difference is measured, measurement imprecisions, for example, as a result of sensor drift, can be partially or completely compensated so that no compensation means is required in this way.

The calculation provides a simple possibility of determining the air mass flow. The resulting error in the calculation of the air mass flow relative to the actual transferred air mass flow is very minimal so that the operating parameter can be adjusted precisely enough. A temperature correction is expedient.

Advantageously, the temperature at the first crankshaft angle and the temperature at the second crankshaft angle are calculated based on the measured average crankcase temperature. For the measurement of the first and the second temperatures, a suitable fast temperature sensor is required. When the temperature is calculated at both points in time based on the average crankcase temperature, a temperature sensor can be employed that is comparatively slow. The temperature sensor, instead of measuring directly the temperature in the crankcase, can also measure the temperature of a correlated component, for example, the wall temperature of the crankcase. In this way, a temperature sensor of a simple design can be used. Complex sealing measures in the area of the temperature sensor are not required when the temperature sensor measures only the wall temperature of the crankcase.

It is provided that the temperature at the first crankshaft angle and the temperature at the second crankshaft angle is calculated based on the measured average crankcase temperature by means of a polytropic change of state and that the polytropic exponent for the state equation is determined by means of a characteristic map. For calculating the temperature at the two crankshaft angles based on the average crankcase temperature, a polytropic change of state in the crankcase between the two crankshaft angles can be assumed. The polytropic change of state records the heat transfer between crankcase and the combustion air contained in the crankcase or the fuel/air mixture, respectively. The polytropic exponent, depending on the heat transfer in the crankcase, can have different values. The polytropic exponent depends on the configuration and construction of the internal combustion engine and on the operating point of the combustion engine. The polytropic exponent can be deposited in a characteristic map in particular as a function of the engine speed and of the combustion air mass or as a function of the engine speed and of the average crankcase temperature. In this way, the combustion air mass can be calculated as a function of the pressure difference at the two crankshaft angles and as a function of the average crankcase temperature.

The operating parameter is advantageously the fuel quantity to be supplied in a working cycle of the internal combustion engine for achieving a predetermined lambda value in the combustion chamber. Preferably, the required fuel quantity is determined based on the air mass flow through the combustion chamber. Based on the determined pressure in the crankcase, it is possible to determine the air mass flow. For a known air mass flow and a preset lambda value, the required fuel quantity can be calculated. It is provided that the determined fuel quantity is supplied to the working cycle that follows the pressure measurement. As a result of the prompt supply of the determined fuel quantity, an operation of the internal combustion engine at the predetermined lambda value is ensured. Advantageously, the pressure in the crankcase is measured at a point in time at which the flow connection to the combustion chamber as well as the intake port are closed off. For a closed-off crankcase, the pressure in the crankcase is a measure of the air quantity enclosed in the crankcase so that, based on this measurement, the air mass flow can be determined.

It is provided that, when starting the internal combustion engine, a predetermined lambda value for cold start or a predetermined lambda value for hot start is selected, based on the measured temperature, and the proper fuel quantity for the selected lambda value is then determined. In a cold start situation, an enriched mixture is required for ignition so that more fuel must be introduced for the same air mass flow. The temperature measurement enables an adjustment of the lambda value and thus of the fuel quantity to be supplied to the temperature. It is provided that the fuel is introduced by means of an electrically actuated fuel valve and the required fuel quantity is metered by controlling the timing of opening and closing the fuel valve.

Expediently, the operating parameter is the ignition timing of a spark plug projecting into the combustion chamber of the internal combustion engine which spark plug ignites the mixture in the combustion chamber. It is provided that, based on the measured engine speed and the determined air mass flow, the ignition timing is determined by means of a characteristic map. In this way, an improved running of the internal combustion engine is achieved.

An internal combustion engine with which the method according to the invention can be performed has a cylinder in which a combustion chamber is formed that is delimited by a reciprocating piston wherein the piston drives a crankshaft that is rotatably supported in the crankcase. The internal combustion engine has an intake for supplying combustion air and an exhaust connected to the combustion chamber. The combustion engine has a device for supplying fuel and a device for controlling the supplied fuel quantity. The internal combustion engine has a pressure sensor for determining the crankcase pressure.

The pressure sensor enables the measurement of the crankcase pressure at predetermined crankshaft angles and, based thereon, the determination of the air mass flow through the internal combustion engine and the supply of an optimal fuel quantity.

Advantageously, the pressure sensor is a relative pressure sensor. The pressure sensor measures in this connection the crankcase pressure relative to a reference pressure. The relative pressure can be a calibrated or non-calibrated reference pressure. A relative pressure sensor is of a simple configuration. In particular, a relative pressure sensor that measures a relative pressure relative to a non-calibrated reference pressure is of a simple and robust configuration. A calibration of the pressure sensor is not required, in particular when the pressure sensor is used for determining the pressure difference of pressures present at two crankshaft angles, preferably a crankshaft angle in the compression phase and a crankshaft angle in the expansion phase of the crankcase.

It is provided that the pressure sensor is arranged in the crankcase. It can also be provided that the internal combustion engine is a two-stroke engine whose crankcase is connected by at least one transfer passage to the combustion chamber; the pressure sensor is then arranged in the transfer passage. Expediently, the internal combustion engine is a mixture-lubricated four-stroke engine and the pressure sensor is arranged in a lubricant reservoir that is connected to the crankcase.

Preferably, the internal combustion engine has a temperature sensor for determining the crankcase temperature. The crankcase temperature serves for correcting the measured pressure value, for selecting a predetermined lambda value for the cold start or the hot start and serves as an input value for the calculation of the transferred combustion air quantity. In particular, the temperature sensor is designed for measuring an average crankcase temperature. It is therefore possible to employ as a temperature sensor a simple temperature sensor that has a comparatively long response time. Advantageously, the temperature sensor is arranged in a wall of the internal combustion engine and measures the temperature of the wall as an average crankcase temperature. In this connection, the wall can be a wall of the crankcase or a wall of the cylinder of the internal combustion engine. In this way, the temperature sensor is not directly exposed to the media in the crankcase. Soiling of the sensor is thus prevented. Sealing of the crankcase in the area of the sensor is also not necessary because the sensor is arranged, separated from the interior of the crankcase, within the wall of the crankcase or the cylinder. However, it can also be provided that the temperature sensor measures the temperature in the crankcase itself. For this purpose, the temperature sensor is advantageously arranged in the crankcase or in a transfer passage.

Preferably, the pressure sensor and the temperature sensor are designed as a combined pressure/temperature sensor. The device for supplying the fuel is in particular a fuel valve.

DESCRIPTION OF THE PREFERRED EMBODIMENTS

Figure 1:
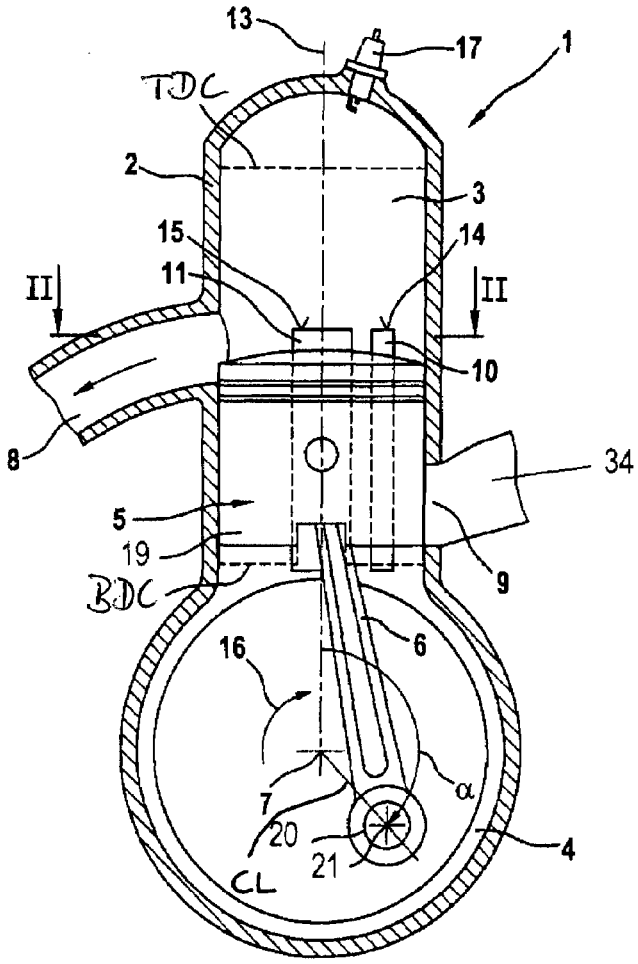
FIG. 1 is a schematic illustration of an internal combustion engine in longitudinal section.

The internal combustion engine illustrated in FIG. 1 is a single cylinder two-stroke engine that is used in particular for a hand-held power tool such as a motor chainsaw, a cut-off machine, a trimmer or the like. The internal combustion engine 1 has a cylinder 2 in which a combustion chamber 3 is formed. A piston 5 is arranged reciprocatingly in the combustion chamber 3. The piston 5 drives by means of a connecting rod 6 the crankshaft 7 that is rotatably supported in the crankcase 4. The connecting rod 6 is secured by means of connecting rod eye 20 on the crankshaft 7. In operation of the internal combustion engine, the crankshaft 7 rotates in the rotational direction 16. The piston 5 moves between top dead center TDC and bottom dead center BDC. The cylinder 2 has a longitudinal central axis 13. The crankshaft angle $\alpha$ is defined between the central axis 13 and a connecting line CL that connects the axis of rotation of the crankshaft 7 and the central axis 21 of the connecting rod eye 20. At the top dead center TDC of the piston 5, the crankshaft angle $\alpha$ is zero degrees and at the bottom dead center BDC it is 180 degrees.

Figure 2:
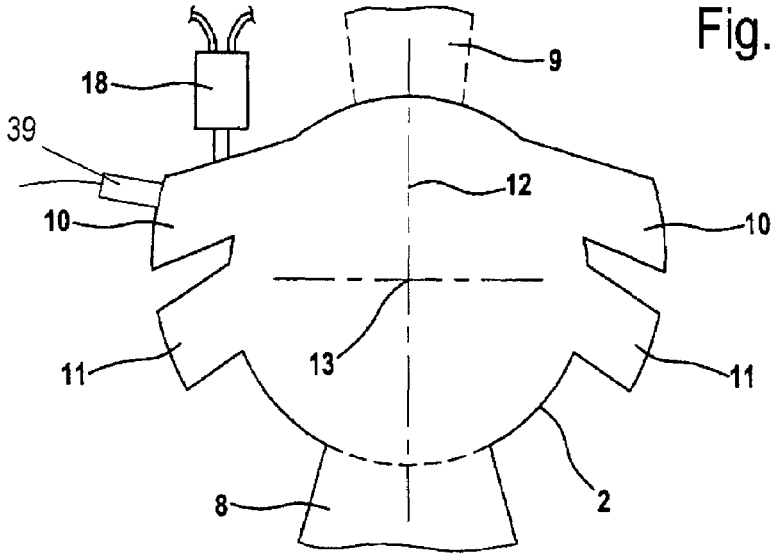
FIG. 2 is a section along the section line II-II of FIG. 1.

The internal combustion engine 1 has an intake passage 34 for combustion air that opens at intake port 9 into the crankcase 4; an exhaust 8 is connected to the combustion chamber 3. In the area of the top dead center TDC, the crankcase 4 is connected by transfer passages 10 and 11 to the combustion chamber 3. As shown in FIG. 2, the internal combustion engine 1 has two transfer passages 10 proximal to the intake port 9 and two transfer passages 11 proximal to the exhaust 8. The transfer passages 10 and 11 are symmetrically arranged relative to a center plane 12 that divides the intake port 9 and the exhaust 8 approximately centrally. As shown in FIG. 1, the transfer passages 10 have transfer ports 14 and the transfer passages 11 have transfer ports 15, respectively, that open into the combustion chamber 3. The intake port 9, the exhaust 8, and the transfer ports 14 and 15 are piston-controlled by the piston skirt 19 of the piston 5. The transfer passages 10 and 11 provide a piston-controlled flow connection between crankcase 4 and combustion chamber 3.

As shown in FIG. 2, a fuel valve 18 for supply of fuel opens into the transfer passage 10. A pressure/temperature sensor 39 is arranged at the transfer passage 10 for measuring the pressure and the temperature within the transfer passage 10. Since the transfer passages 10 and 11 each have an open end facing the crankcase 4, the pressure/temperature sensor 39 thus measures also the pressure and temperature in the crankcase 4. The transfer passages 10 and 11 can also be open across their entire length toward the interior of the cylinder.

The pressure/temperature sensor 39 measures in particular an average crankcase temperature $T_0$ and a relative pressure. The relative pressure is measured relative to a calibrated or non-calibrated reference pressure. The reference pressure can be the ambient pressure; the pressure in the intake passage; the pressure at the clean side of an air filter through which combustion air is taking into the internal combustion engine 1; the pressure in the cylinder 2; or the pressure in the muffler connected to the exhaust 8 of the internal combustion engine 1. The pressure sensor of the pressure/temperature sensor 39 has advantageously a temperature compensation means. Advantageously, the temperature compensation means of the pressure sensor is used as a temperature sensor, i.e., the signal of the temperature compensation means is used as a temperature signal. In this way, no additional temperature sensor is required. For measuring the temperature, in particular the average crankcase temperature $T_0$, the already present temperature compensation means can be utilized. In operation of the internal combustion engine 1, in the area of the top dead center TDC of the piston 5 combustion air is sucked into the crankcase 4 through the intake port 9. When performing the downward stroke, the piston 5 causes the combustion air in the crankcase 4 to be compressed. As soon as the piston skirt 19 opens the transfer ports 14 and 15, the combustion air flows from the crankcase 4 into the combustion chamber 3. The fuel valve 18 introduces the required fuel quantity x into the combustion air that is being transferred. During the upward stroke of the piston 5, the fuel/air mixture in the combustion chamber 3 is compressed and is ignited in the area of the top dead center TDC of the piston 5 by the spark plug 17 projecting into the combustion chamber 3. The combustion accelerates the piston 5 in the direction toward the crankcase 4. The downward stroke causes the piston skirt 19 to open the exhaust 8, and the exhaust gases escape from the combustion chamber 3.

Figure 3:
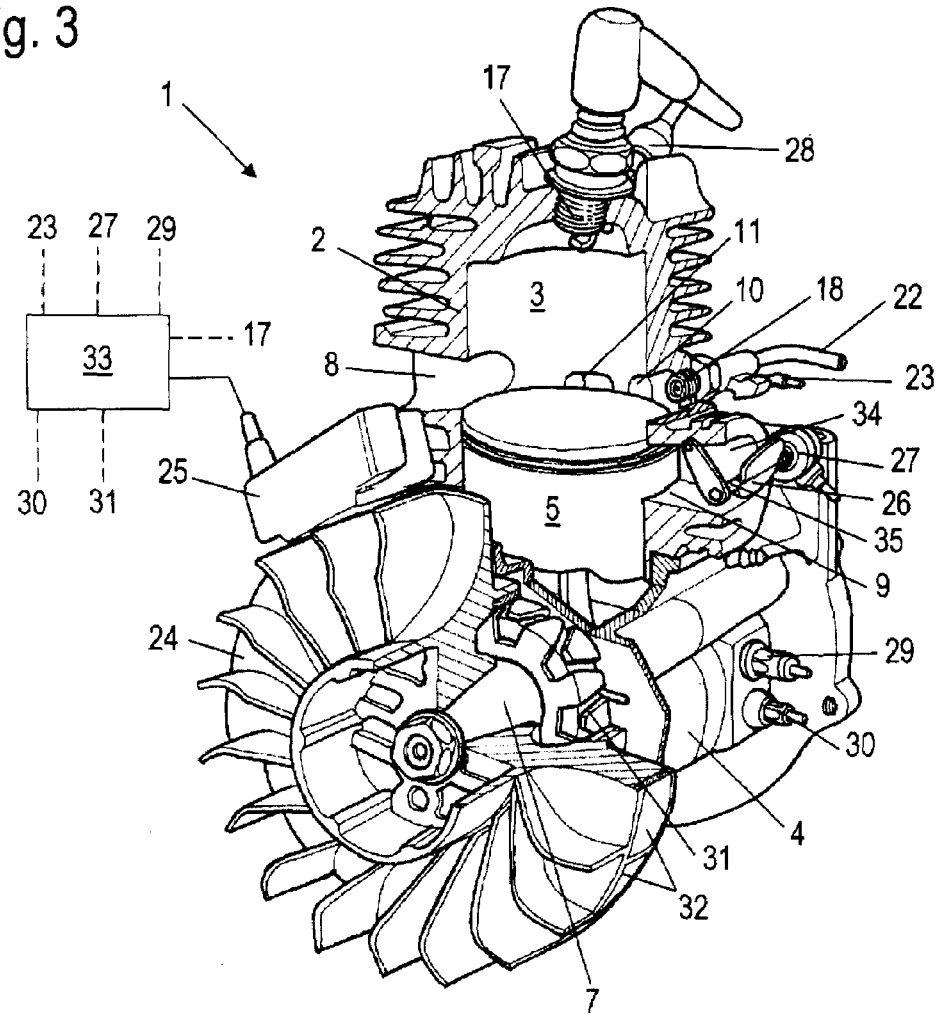
FIG. 3 is a perspective, partially sectioned, illustration of an internal combustion engine.

In FIG. 3, the internal combustion engine 1 is illustrated in a perspective view and partially in section. Instead of the combined pressure/temperature sensor 39, a pressure sensor 29 and a separate temperature sensor 30 are provided in the internal combustion engine 1 illustrated in FIG. 3. The sensors 29, 30 are arranged in the crankcase 4.

Figure 4:
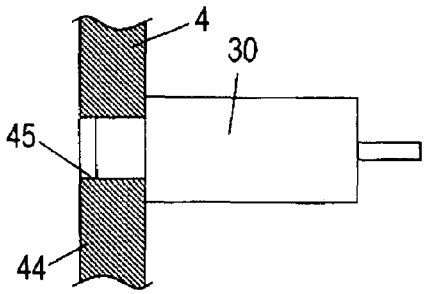
FIG. 4 is a schematic section illustration of a first arrangement of the temperature sensor.
Figure 5:
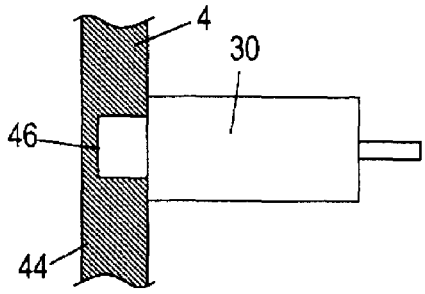
FIG. 5 is a schematic section illustration of a second arrangement of the temperature sensor.

FIGS. 4 and 5 show possible arrangements of the temperature sensor 30 in the wall 44 of the crankcase 4. In the embodiment illustrated in FIG. 4, the temperature sensor 30 is arranged in an opening 45 in the wall 44 of the crankcase 4. The temperature sensor 30 is therefore exposed to the temperature of the gases present within the crankcase 4. The temperature sensor 30 measures directly the gas temperature in the crankcase 4.

In the embodiment illustrated in FIG. 5, the temperature sensor 30 is arranged in a recess 46 in the wall 44. The recess 46 is closed off to the interior of the crankcase 4. The temperature sensor 30 measures the crankcase temperature $T_0$ as an average temperature of the wall of the crankcase 4. The temperature sensor 30 is separated from the interior of the crankcase 4. Therefore, it is not required to seal the crankcase 4 in the area of the temperature sensor 30.

As shown in FIG. 3, a rotatably supported throttle 26 is arranged as a throttle element in the intake passage 34. The throttle 26 is supported on a throttle shaft 35. An angle-of-rotation sensor 27 is arranged on the throttle shaft 35 by means of which the position of the throttle 26 can be determined. The position of the throttle 26 has an effect on the amount of air that flows through the intake port 9 into the crankcase 4.

A generator 31 is arranged on the crankshaft 7. The generator 31 is configured as a universal generator. Based on the signal of the generator 31, the position of the crankshaft 7, i.e., the crankshaft angle $\alpha$, can be determined. Moreover, a fan wheel 24 is secured on the crankshaft 7. On the circumference of the fan wheel 24, an ignition module 25 is arranged. The fan wheel 24 supports two pole shoes 32 that induce the ignition voltage in the ignition module 25. The generator 31 can replace the ignition module 25 so that the internal combustion engine 1 only has a generator 31 and no ignition module 25. The voltage required for ignition is then generated by the generator 31. The cylinder 2 has a decompression valve 28 that projects into the combustion chamber 3 and reduces the pressure in the combustion chamber 3 when starting the internal combustion engine 1; this makes starting of the engine 1 easier.

The internal combustion engine 1 has a control unit 33 that is connected to the ignition module 25. The control unit 33 can be integrated into the ignition module 25. As illustrated schematically in FIG. 3, the control unit 33 is connected to the generator 31, to the temperature sensor 30, to the pressure sensor 29, to the angle-of-rotation sensor 27, to a control line 23 of the fuel valve 18, and to the spark plug 17. The fuel valve 18 is connected by a fuel line 22 to the fuel tank. Preferably, a fuel pump and a pressure reservoir are arranged between the fuel tank and the fuel valve 18. The supplied quantity of fuel can be controlled by opening and closing the fuel valve 18 by means of the control line 23.

Figure 6:
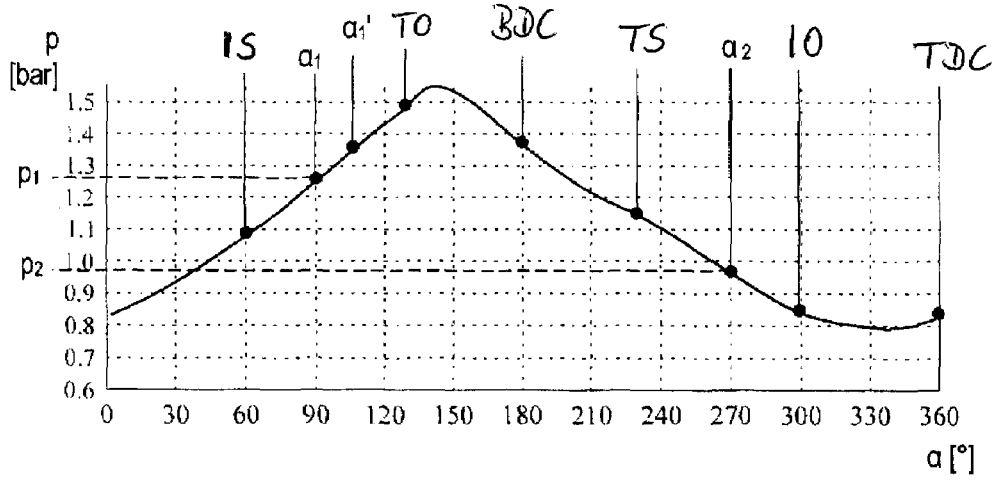
FIG. 6 is a graph of the course of the pressure in the crankcase as a function of the crankshaft angle.

In FIG. 6, the pressure p in the crankcase 4 is illustrated as a function of the crankshaft angle $\alpha$. The pressure p increases initially upon downward stroke of the piston 5. At the crankshaft angle IS, the intake port 9 into the crankcase 4 is shut. Subsequently, the transfer passages 11 and 12 open into the combustion chamber 3 at the crankshaft angle TO. Shortly after passing the crankshaft angle TO, the pressure p in the crankcase 4 will drop. The piston 5 moves toward the crankcase 4 to bottom dead center BDC and subsequently upwardly again in the direction toward the combustion chamber 3. At the crankshaft angle TS, the transfer ports 14, 15 are shut by the piston skirt 19. Subsequently, the intake port 9 opens into the crankcase 4 at crankshaft angle IO. Between shutting of the intake port 9 and opening of the transfer ports 14, 15 during upward stroke of the piston 5, the crankcase 4 is connected neither to the intake port 9 nor to the combustion chamber 3. The crankcase 4 thus contains a defined (closed) volume of combustion air. At the crankshaft angle $\alpha_1$ which is between shutting of the intake IS and opening of the transfer port TO, the pressure sensor 29 measures pressure $p_1$ in the crankcase 4. When the piston 5 moves upwardly, the crankcase is closed off between shutting of the transfer passages (TS) and opening of the intake (IO). At the crankshaft angle $\alpha_2$ during expansion of the crankcase 4, the pressure sensor 29 measures a second pressure $p_2$ in the crankcase 4. Accordingly, a first pressure measurement is provided during the compression stroke, i.e., during the downward stroke of the piston 5, and a second pressure measurement is provided during the expansion stroke, i.e., as the piston 5 moves upwardly.

Figure 7:
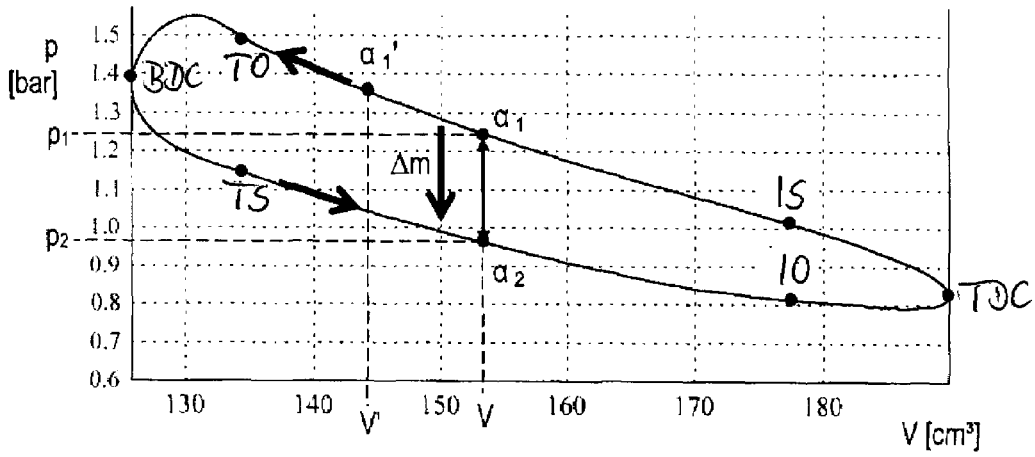
FIG. 7 is a graph of the course of the pressure in the crankcase as a function of the crankcase volume.

In FIG. 7, the pressure p in the crankcase 4 is illustrated as a function of the volume V of the crankcase 4. As shown in FIG. 7, the measurement of the pressures $p_1$ and $p_2$ in the crankcase 4 is carried out at identical crankshaft angles at which angles the volume V of the crankcase 4 is identical. The pressure difference between the two crankshaft angles $\alpha_1$ and $\alpha_2$ is the result of the transferred combustion air quantity $\Delta m$ that is being transferred into the combustion chamber 3. The pressure however can be measured also at crankshaft angles $\alpha$ where the volume V of the crankcase 4 is different. FIGS. 6 and 7 show in an exemplary way a pressure measurement at crankshaft angle $\alpha_1'$ at which the crankcase 4 has a volume V' that is smaller than the volume V at crankshaft angle $\alpha_2$.

Figure 8:
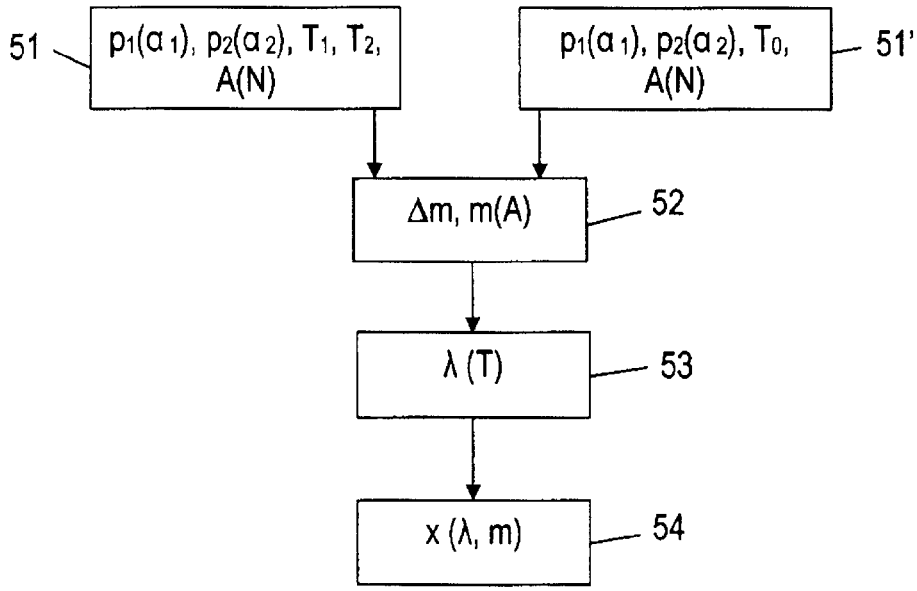
FIG. 8 is a flow chart of a first method for determining the air mass flow through the combustion chamber.

In FIG. 8, a method for determining the fuel quantity x for obtaining the predetermined lambda value $\lambda$ in the combustion chamber 3 is illustrated. In the step 51, the pressure $p_1$ at the first crankshaft angle $\alpha_1$, the pressure $p_2$ at the second crankshaft angle $\alpha_2$, the corresponding temperatures $T_1$ and $T_2$ in the crankcase 4, and the engine speed N are measured. In this connection, the pressures $p_1$ and $p_2$ are measured in particular as relative pressures $p_{1,rel}$ and $p_{2,rel}$ wherein the index "rel" makes clear that the relative pressures $p_{1,rel}$ and $p_{2,rel}$ are measured relative to a reference pressure. This simplifies the pressure measurement. However, the pressures $p_1$ and $p_2$ can also be measured as absolute pressures. The crankshaft angles $\alpha_1$ and $\alpha_2$ are between shutting of the intake port 9 (IS) and opening the transfer passages (TO) or shutting of the transfer passages (TS) and opening of the intake port 9 (IO), as shown in FIGS. 6 and 7. The two crankshaft angles $\alpha_1$ and $\alpha_2$ are selected such that at both crankshaft angles $\alpha_1$ and $\alpha_2$ the volume V of the crankcase 4 is identical. However, the volume V' of the crankcase 4 can also be different at the two crankshaft angles $\alpha_1$ and $\alpha_2$. In this case, the volume of the crankcase 4 must be known for the first crankshaft angle $\alpha_1$ as well as for the second crankshaft angle $\alpha_2$. Both volumes are entered into the calculation of the transferred combustion air quantity $\Delta m$. Based on the measured engine speed N, the number of working cycles A is determined. In the two-stroke engine illustrated in FIGS. 1 to 3, the number of working cycles A corresponds to the engine speed because for each revolution of the crankshaft 7 combustion air is transferred into the combustion chamber 3. In the case of a four-stroke engine, the number of working cycles A is derived from the equation A=N/2 wherein A is the number of working cycles and N is the engine speed. In a four-stroke engine, combustion air flows into the combustion chamber only for every other revolution of the crankshaft.

Instead of the step 51, the step 51' can be provided. In the step 51', an average crankcase temperature $T_0$ is measured in addition to the pressure $p_1$ at the first crankshaft angle $\alpha_1$, the pressure $p_2$ at the second crankshaft angle $\alpha_2$, and the engine speed N. The crankcase temperature $T_0$ can be measured as the gas temperature of the gas enclosed in the crankcase 4. The average crankcase temperature $T_0$ however can also be measured as the wall temperature of the crankcase 4 or of the cylinder 2. The measurement of the average crankcase temperature $T_0$ is realized in the area of the crankcase 4 in which an average, representative temperature is present, i.e. an area that is not greatly cooled, for example, by evaporation of the fuel or by incoming combustion air, or that is not heated locally, for example, by friction of moving parts. Local heating can be present in particular in the area of bearings of the crankshaft 7. In particular, the measurement of the crankcase temperature is realized in an area in which an excellent temperature transfer from the crankcase interior to the wall of the crankcase is present. The arrangement of the temperature sensor is to be selected appropriately. In the case of measurement of several temperatures $T_1$, $T_2$ instead of an average temperature $T_0$, an appropriate arrangement in an area in which a representative temperature is present is advantageous. The temperatures $T_1$ and $T_2$ can be calculated based on the average crankcase temperature $T_0$. For this purpose, a polytropic change of state in the crankcase 4 between the crankshaft angles $\alpha_1$ and $\alpha_2$ is assumed. The polytropic exponent n is determined for the specific internal combustion engine 1 and can be saved or deposited, for example, in a characteristic map.

In the step 52 based on the measured pressure values $p_1$ and $p_2$ and the temperature values $T_1$ and $T_2$ that are either measured or determined based on the average crankcase temperature $T_0$, the combustion air quantity $\Delta m$ is determined. The combustion air quantity $\Delta m$ is calculated in accordance with the laws of physics, i.e., the ideal-gas law, using the temperatures $T_1$ and $T_2$ at the crankshaft angles $\alpha_1$ and $\alpha_2$, the volume V of the crankcase 4 at the crankshaft angles $\alpha_1$ and $\alpha_2$, and the ideal gas constant. In this connection, the combustion air quantity $\Delta m$ is proportional to the volume V and to the difference of the quotients of pressure $p_1$, $p_2$ and the temperatures $T_1$ and $T_2$ at the two crankshaft angles $\alpha_1$ and $\alpha_2$. Based on the combustion air quantity $\Delta m$ transferred for each working cycle, the air mass flow m is determined by means of the equation $m=\Delta m*A/60$, wherein m is the air mass flow per second, $\Delta m$ is the combustion air quantity transferred for the working cycle, respectively, and A is the number of working cycles per minute.

In the next step 53, the lambda value λ that is to be achieved is determined as a function of the measured temperature T. For a cold start, an enriched mixture is desired so that at lower temperatures T a different lambda value is preset. In the step 54, the fuel quantity x to be supplied is determined based on the calculated air mass flow m and the desired lambda value λ. The determination of the fuel quantity x to be supplied can also be done based on the combustion air quantity Δm that is transferred for each working cycle instead of being based on the air mass flow m, i.e., based on the air quantity transferred per second.

Figure 9:
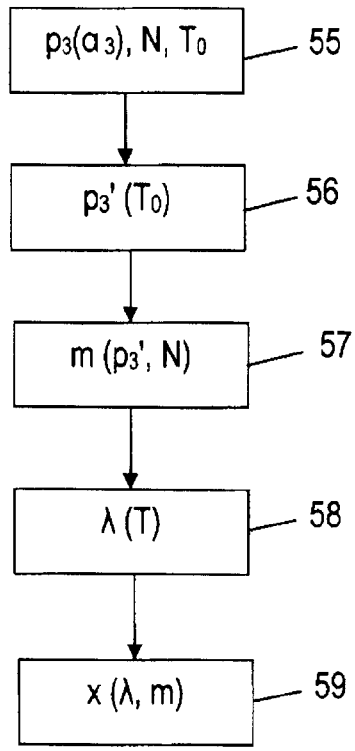
FIG. 9 is a flow chart of a second method for determining the air mass flow through the combustion chamber.

In FIG. 9, a further method for determining the required fuel quantity x is illustrated. In step 55, the pressure $p_3$ in the crankcase 4 is measured at a predetermined crankshaft angle $\alpha_3$. The crankshaft angle $\alpha_3$ is selected such that the crankcase 4 is closed off relative to the intake port 9 and the combustion chamber 3. The crankshaft angle $\alpha_3$ is thus between closing of the intake (IS) and opening of the transfer passages (TO) or between closing of the transfer passages (TS) and opening of the intake IO. By means of the ignition module 25, the engine speed N of the crankshaft 7 is determined. The engine speed N can also be determined by means of the generator 31. Moreover, the average temperature $T_0$ in the crankcase 4 is measured. In the next step 56, the measured pressure value $p_3$ is corrected based on the measured temperature $T_0$. Based on the corrected pressure value $p_3'$, the air mass flow m is determined in the next step 57 based on the characteristic map. In the characteristic map, the air mass flow m is deposited as a function of the engine speed N and the pressure $p_3$ in the crankcase 4 at a predetermined crankshaft angle α. For each crankshaft angle $\alpha_3$, a different characteristic map results so that the measurement of the pressure $p_3$ for each revolution of the crankshaft 7 is done at the same point in time, i.e. at the same crankshaft angle $\alpha_3$.

In the next step 58, based on the measured average temperature $T_0$ the desired lambda value λ is determined. In this case, a different lambda value for the cold start, i.e., for lower temperatures T of the internal combustion engine 1, is provided also. In the step 59, the fuel quantity x is determined that is required for achieving the desired lambda value λ for the determined air mass flow m. The determined fuel quantity x is supplied into the combustion chamber 3 during the following revolution of the crankshaft 7, i.e., during the subsequent working cycle A. When the crankshaft angle $\alpha_3$ is positioned before the crankshaft angle at which the transfer passages 10 and 11 open, the determined fuel quantity x can also be directly introduced by means of the fuel valve 18 for the current working cycle. It can also be provided that the determined fuel quantity x is supplied only for a later, for example, the working cycle after next following the pressure measurement.

The determination of the fuel quantity x to be supplied and the control of the fuel valve 18 is realized in the method according to FIG. 8 as well as in the method according to FIG. 9 by the control unit 33.

Figure 10:
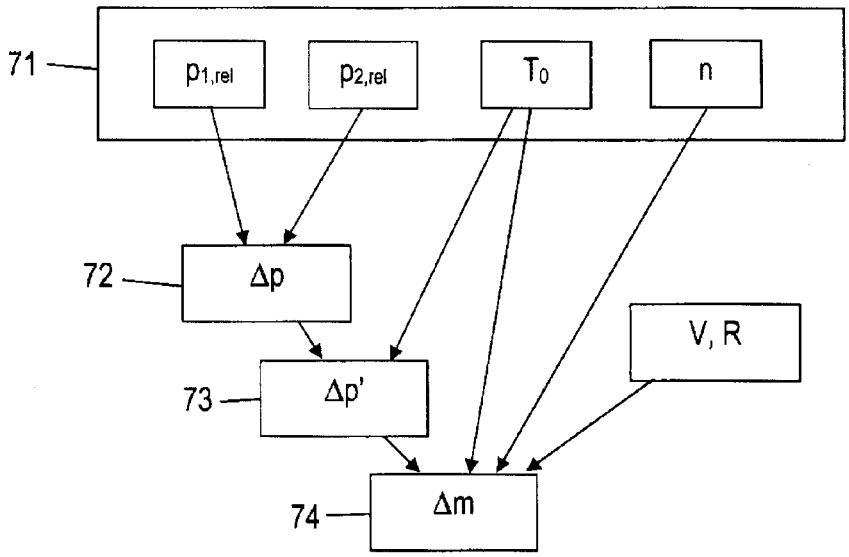
FIG. 10 is a flow chart of a third method for determining the air mass flow through the combustion chamber.

FIG. 10 shows schematically a further method for determining the combustion air quantity Δm. In the step 71, the pressure $p_{1,rel}$ at the crankshaft angle $\alpha_1$, the pressure $p_{2,rel}$ at the crankshaft angle $\alpha_2$, and the average temperature $T_0$ are measured. The index "rel" indicates that the pressures $p_{1,rel}$ and $p_{2,rel}$ are relative pressures measured relative to a reference pressure and are not absolute pressures. The polytropic exponent n is derived from a characteristic map. In the step 72, the pressure difference Δp is calculated as a difference of the pressures $p_{1,rel}$ and $p_{2,rel}$. Because the pressure difference Δp is determined, it is inconsequential which reference pressure is selected for the measurement of the pressure values $p_{1,rel}$ and $p_{2,rel}$. It can however be advantageous to determine absolute pressure values, for example, when an absolute pressure sensor for pressure measurement is already present and can be utilized. A step 73 can be provided in which the pressure difference Δp is corrected by means of the measured temperature $T_0$. In the step 74, the combustion air quantity Δm is determined based on the corrected pressure difference Δp', the temperature $T_0$, the polytropic exponent n, the crankcase volume V, and the gas constant R. However, it can also be provided that in step 74 the combustion air quantity Δm is directly determined based on the pressure difference Δp. The step 73 is not needed in this case. The determination of the combustion air quantity Δm is then realized by means of a characteristic map. In this method, the determination of the combustion air quantity Δm is also realized by means of the control unit 33.

Figure 11:
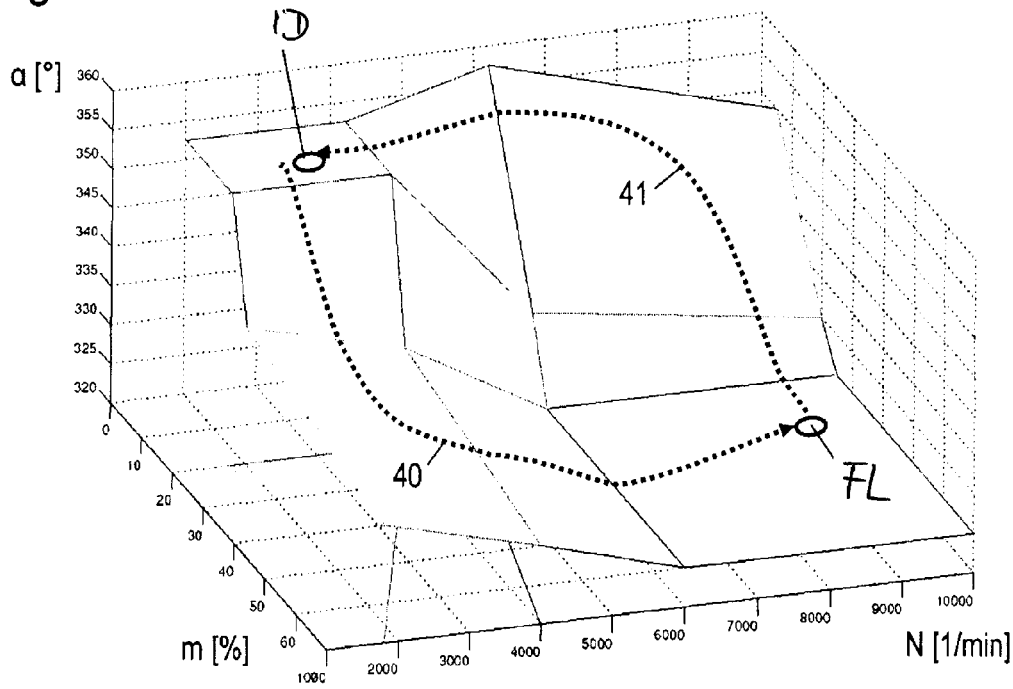
FIG. 11 is a diagram that illustrates the ignition timing as a function of the air mass flow and of the engine speed.

In addition to the fuel quantity x supplied through the fuel valve 18, the control unit 33 also controls the ignition timing IT at which time the spark plug 17 ignites the fuel/air mixture in the combustion chamber 3. In FIG. 11, the control of the ignition timing as a function of the engine speed N taken at the crankshaft 7 and as a function of the air mass flow m, indicated in percent of the maximum air mass flow, is illustrated. During idling ID, the engine speed N is low and the air mass flow m is minimal. During idling ID a delayed ignition is desired. The ignition timing is illustrated in FIG. 11 as a function of the crankshaft angle α. During idling, ignition is realized shortly before top dead center TDC, i.e., at a crankshaft angle α of somewhat less than 360 degrees. At full load FL, an advanced ignition is desired. At high engine speed N and a high air mass flow m, ignition is realized significantly before top dead center TDC at a crankshaft angle α between 320 degrees and 330 degrees. When accelerating the internal combustion engine 1 from idling ID, the throttle 26 is opened. This causes the air mass flow m to increase. However, the engine speed N increases only slowly in comparison. This is indicated in FIG. 11 by the acceleration curve 40. During acceleration, it is provided that the ignition timing is advanced already upon opening of the throttle 26, i.e., upon increase of the air mass flow m, even though the engine speed N has not yet noticably increased. In this way, the torque of the internal combustion engine 1 is increased and the acceleration is facilitated. When decelerating from full load FL, the reverse behavior is provided. Upon closing of the throttle 26 from the full load position (FL), the air mass flow m drops immediately. The engine speed N however drops only slowly in comparison. It is provided that upon lowering of the air mass flow m, even at high engine speed N, the ignition timing is delayed as shown by curve 41. In this way, an improved running of the internal combustion engine will result. For the calculation of the air mass flow m as well as for the determination of the air mass flow m based on the characteristic map, an angle-of-rotation sensor 27 can be provided additionally so that even in the case of failure of the pressure sensor 29 or 39 a controlled fuel supply is enabled.

Figure 12:
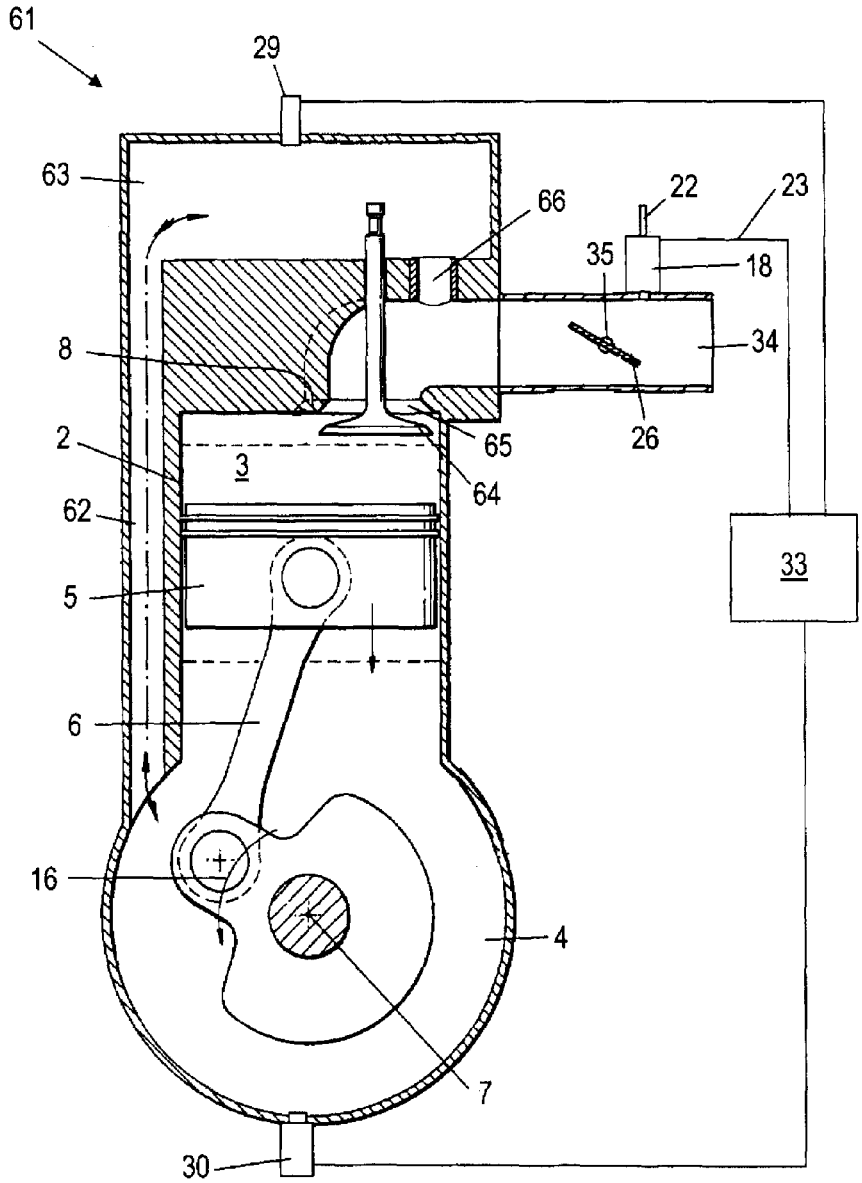
FIG. 12 is a schematic illustration of an internal combustion engine in longitudinal section.

In FIG. 12, an embodiment of an internal combustion engine 61 is illustrated in which the required fuel quantity x is determined based on the pressure in the crankcase 4. The internal combustion engine 61 is a single cylinder four-stroke engine. The same reference numerals that have been used for internal combustion engine 1 are used for the internal combustion engine 61 inasmuch as identical components are concerned.

The internal combustion engine 61 has an intake passage 34 in which a throttle 26 is pivotably supported on a throttle shaft 35. A fuel valve 18 opens into the intake passage 34. The fuel valve 18 is connected by means of control line 23 to a control unit 33. The control unit 33 is also connected to the pressure sensor 29 and the temperature sensor 30. The intake passage 34 opens into the combustion chamber at intake port 65 that is controlled by valve 64. The valve 64 is driven by a camshaft (not illustrated in FIG. 12) that is rotatably driven in cam chamber 63. The camshaft is for example coupled by a gear or a belt drive to the movement of the crankshaft 7. The valve 64 can be controlled also by a rocker arm. An exhaust 8 indicated in dashed lines in FIG. 12 is connected to the combustion chamber 3 and is also valve-controlled.

The temperature sensor 30 is arranged on the crankcase 4 and measures the temperature in the crankcase 4. The crankcase 4 is connected by passage 62 to the cam chamber 63. The tappet push rods for actuating the rocker arms for the valve control can be guided in the passage 62. When the valves of the internal combustion chamber 61 are cam-controlled, the gear or the belt drive for driving the camshaft can be arranged in the passage 62. Since the cam chamber 63 is in flow communication by means of passage 62 with the crankcase 4, approximately the same pressure is present in the cam chamber 63 and in the crankcase 4. The pressure sensor 29 arranged in the cam chamber 63 measures thus the pressure in the crankcase 4.

The cam chamber 63 is connected by connecting passage 66 to the intake passage 34. The connecting passage 66 is arranged adjacent to the intake port 65 of the combustion chamber. Through the passage 62, the cam chamber 63, and the connecting passage 66, the crankcase 4 is in flow communication with the intake passage 34. The pressure that is present within the crankcase depends on the pressure in the intake passage. However, because of the piston movement a different pressure course results. The connecting passage 66 acts as a throttle that causes different pressures in the crankcase 4 and the intake passage 34.

The combustion air quantity entering the combustion chamber 3 can be determined based on the measured pressure and temperature values and the engine speed N of the internal combustion engine and/or the position of the throttle 26. For this purpose, on the throttle shaft 35 an angle-of-rotation sensor can be arranged (not illustrated in FIG. 12).

In the internal combustion engine 61 illustrated in FIG. 12 and configured as a four-stroke engine, the determination of the fuel quantity X to be supplied can also be realized by means of a characteristic map in accordance with the method illustrated in FIG. 9. For this purpose, the pressure $p_3$ is measured in the crankcase 4 at crankshaft angle $\alpha_3$. Moreover, by means of the temperature sensor 30 the average temperature $T_0$ in the crankcase 4 is measured. The measured pressure value $p_3$ is corrected by means of the measured temperature $T_0$ and the air mass flow m is determined based on the engine speed N and based on the corrected pressure value $p_3'$.

The pressure sensor 29 can be arranged also in the passage 62 or in the crankcase 4. Instead of a separate pressure sensor 29 and an additional temperature sensor 30, it is also possible to use a combined pressure/temperature sensor.

Figure 13:
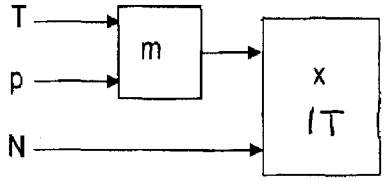
FIG. 13 is a diagram illustrating the general sequence of steps of the method according to the invention.

In FIG. 13, the course of the method steps is illustrated in general. Accordingly, based on at least one measured temperature T and at least one measured pressure p, the air mass flow m is determined, for example, by means of a characteristic map or by calculation. Based on the determined air mass flow m and the engine speed N of the internal combustion engine 1, 61, adjustable values for operating parameters, for example, for the fuel quantity x or the ignition timing IT, are determined, for example, by means of characteristic maps. Advantageously, for determining the adjustable values, the measured temperature T, in particular the average crankcase temperature $T_0$, is used also. The determined values are then adjusted or set by the control unit 33. It is also possible to determine the ignition timing IT and the fuel quantity x to be supplied directly from the measured pressure p.

It is also possible to use, instead of the crankcase temperature, another temperature, in particular a temperature of a different component. Instead of the crankcase pressure, it is also possible to measure the pressure in a different engine component. The principle of determining the mass flow through a component or a change of the mass of the gas that is enclosed in the component by measurement of the pressure difference and of a component temperature is transferable onto other components. For example, with an appropriate measurement of a pressure difference in the combustion chamber and of the temperature of the cylinder in an area in which approximately combustion chamber temperature is present, the air mass flow through the combustion chamber can be determined. Accordingly, the determination of the exhaust mass flow through a muffler can be determined by determining the difference of the pressure at two points in time and by measuring the temperature, in particular by measuring the temperature of the muffler. The principle according to the invention can advantageously be applied also to other components.

The specification incorporates by reference the entire disclosure of German priority document 10 2006 002 486.9 having a filing date of 19 January 2006.

While specific embodiments of the invention have been shown and described in detail to illustrate the inventive principles, it will be understood that the invention may be embodied otherwise without departing from such principles.

What is claimed is:

1. A method for operating an internal combustion engine that is a single cylinder two-stroke engine that comprises a cylinder with a combustion chamber, which combustion chamber is delimited by a reciprocating piston that drives a crankshaft rotatably supported in a crankcase, wherein the internal combustion engine further comprises an intake passage, an exhaust connected to the combustion chamber, a device supplying fuel, and a control device controlling at least one operating parameter of the internal combustion engine; the method comprising the steps of:

a) measuring a pressure in operation of the internal combustion engine;

b) determining an adjustable value for at least one operating parameter of the internal combustion engine based on the measured pressure of the step a);

c) setting the determined adjustable value of step b);

wherein in the step a) the pressure in the crankcase is measured at a first predetermined crankshaft angle during a compression phase and is measured at a second predetermined crankshaft angle during an expansion phase; and wherein the crankcase is closed off at the first and second predetermined crankshaft angles.

2. The method according to claim 1, wherein in the step a) the pressure is measured in the crankcase.

3. The method according to claim 1, wherein in the step a) the pressure is measured as a relative pressure relative to a reference pressure.

4. The method according to claim 1, further comprising the step of measuring a temperature of the internal combustion engine.

5. The method according to claim 4, wherein the temperature is a component temperature.

6. The method according to claim 4, wherein the temperature is measured in the crankcase.

7. The method according to claim 6, wherein the temperature is an average crankcase temperature.

8. The method according to claim 6, wherein the pressure and the temperature are measured in the crankcase by a combined pressure/temperature sensor.

9. The method according to claim 1, wherein, based on the pressure measured in the step a), an air quantity flowing through the combustion chamber is determined.

10. The method according to claim 9, further comprising the step of measuring the engine speed of the internal combustion engine.

11. The method according to claim 10, wherein the air quantity is determined with a characteristic map providing the air quantity as an air mass flow as a function of the engine speed and the pressure in the crankcase at the predetermined crankshaft angle.

12. The method according to claim 11, wherein the pressure is corrected based on a measured temperature and wherein the corrected pressure is used for determining the air mass flow in the characteristic map.

13. The method according to claim 10, wherein the air quantity is determined with a characteristic map providing the air quantity as an air mass flow as a function of the engine speed and a pressure difference between a first pressure measured at a first predetermined crankshaft angle and a second pressure measured at a second predetermined crankshaft angle.

14. The method according to claim 13, wherein the pressure difference is corrected based on a measured temperature and wherein the corrected pressure difference is used for determining the air mass flow in the characteristic map.

15. The method according to claim 9, wherein the air quantity flowing through the combustion chamber is calculated.

16. The method according to claim 15, wherein the crankcase has a first volume at the first predetermined crankshaft angle and a second volume at the second predetermined crankshaft angle, wherein the first volume and the second volume are identical.

17. The method according to claim 15, wherein the crankcase has a first volume at the first predetermined crankshaft angle and a second volume at the second predetermined crankshaft angle, wherein the first volume is different from the second volume.

18. The method according to claim 1, wherein the operating parameter is a fuel quantity to be supplied for a working cycle of the internal combustion engine for achieving a predetermined lambda value in the combustion chamber.

19. The method according to claim 18, wherein the fuel quantity is supplied in a working cycle following a working cycle in which the pressure has been measured.

20. The method according to claim 18, wherein, when starting the internal combustion engine, a predetermined lambda value for a cold start or a predetermined lambda value for a hot start is selected based on the measured temperature and the fuel quantity matching the selected predetermined lambda value is determined.

21. The method according to claim 18, wherein the fuel quantity is supplied through a fuel valve and is controlled by controlling the timing of opening and closing of the fuel valve.

22. The method according to claim 1, wherein the operating parameter is an ignition timing of the internal combustion engine.

23. The method according to claim 22, wherein the ignition timing is determined with a characteristic map based on a measured engine speed and an air mass flow that has been determined.

24. A method for operating an internal combustion engine that comprises a cylinder with a combustion chamber, which combustion chamber is delimited by a reciprocating piston that drives a crankshaft rotatably supported in a crankcase, wherein the internal combustion engine further comprises an intake passage, an exhaust connected to the combustion chamber, a device supplying fuel, and a control device controlling at least one operating parameter of the internal combustion engine; the method comprising the steps of;

a) measuring a pressure in operation of the internal combustion engine and measuring the engine speed of the internal combustion engine, wherein the pressure is measured in the crankcase at a predetermined crankshaft angle;

b) determining an adjustable value for at least one operating parameter of the internal combustion engine based on the measured pressure of the step a);

c) setting the determined adjustable value of step b);

wherein, based on the pressure measured in the step a), an air quantity flowing through the combustion chamber is calculated;

wherein the internal combustion engine is a two-stroke engine having at least one transfer passage through which the combustion air sucked into the crankcase passes into the combustion chamber, wherein the air quantity is calculated as air mass flow m with equation $m=\Delta m*A/60$—with A being the number of working cycles per minute and m being the air mass flow per second—based on a calculation of a combustion air mass $\Delta m$ transferred into the combustion chamber for one working cycle by employing the ideal-gas law, wherein the pressure and the temperature of the first predetermined crankshaft angle; the pressure and the temperature of the second predetermined crankshaft angle; volumes of the crankcase at the first and second predetermined crankshaft angles; and the gas constant are used in the ideal-gas law.

25. The method according to claim 24, wherein the temperature at the first predetermined crankshaft angle and the temperature at the second predetermined crankshaft angle are calculated based on a measured average crankcase temperature.

26. The method according to claim 25, wherein the temperature at the first predetermined crankshaft angle and the temperature at the second predetermined crankshaft angle are calculated based on a polytropic change of state and wherein a polytropic exponent for a state equation is determined with a characteristic map.

27. The method according to claim 24, wherein the air quantity is calculated based on a pressure difference of the pressure at the first predetermined crankshaft angle and of the pressure at the second predetermined crankshaft angle.

28. An internal combustion engine comprising:

a cylinder having a combustion chamber;

a reciprocating piston arranged reciprocatingly in the cylinder and delimiting the combustion chamber;

a crankcase attached to the cylinder;

a crankshaft rotatably supported in the crankcase and driven by the piston;

an intake passage supplying combustion air;

an exhaust connected to the combustion chamber;

a device for supplying fuel;

a control device controlling the internal combustion engine;

a pressure sensor for determining a crankcase pressures;

a temperature sensor measuring a crankcase temperature of the crankcase, wherein the temperature sensor is adapted to measure the average crankcase temperature.

29. The internal combustion engine according to claim 28, wherein the pressure sensor is a relative pressure sensor.

30. The internal combustion engine according to claim 28, wherein the pressure sensor is arranged in the crankcase.

31. The internal combustion engine according to claim 28 in the form of a two-stroke engine, comprising at least one transfer passage connecting the crankcase to the combustion chamber, wherein the pressure sensor is arranged in the at least one transfer passage.

32. The internal combustion engine according to claim 28 in the form of a mixture-lubricated four-stroke engine having a lubricant reservoir connected to the crankcase, wherein the pressure sensor is arranged in the lubricant reservoir.

33. The internal combustion engine according to claim 28, wherein the temperature sensor is arranged in a wall of the internal combustion engine and measures a temperature of the wall as said average crankcase temperature.

34. The internal combustion engine according to claim 28, wherein the pressure sensor and the temperature sensor are combined to a combined pressure/temperature sensor.

35. The internal combustion engine according to claim 28 wherein the device for supplying fuel is a fuel valve.

* * * * *